US005901719A

United States Patent [19]

Garcia Martinez

[11] Patent Number: 5,901,719

[45] Date of Patent: May 11, 1999

[54] DEVICE FOR PRESSURIZED CLEANING OF COOLING CIRCUITS IN AUTOMOBILE VEHICLE ENGINES

[76] Inventor: Juan Ramon Garcia Martinez, Plaza de la Cruz, 3, Alicante, Spain, 03011

[21] Appl. No.: 08/926,231

[22] Filed: Sep. 10, 1997

[30] Foreign Application Priority Data

Sep. 17, 1996 [ES] Spain ..... 9602373 U

[51] Int. Cl.[6] ..... B08B 9/00

[52] U.S. Cl. ..... 134/166 R; 134/169 A; 134/113; 123/198 A

[58] Field of Search ..... 134/166 R, 169 A, 134/168 R, 113; 123/198 A

[56] References Cited

U.S. PATENT DOCUMENTS

| | | | |
|---|---|---|---|
| 2,222,516 | 11/1940 | Powell et al. | 134/169 A |
| 2,632,719 | 3/1953 | Tankersley | 134/169 A |
| 4,059,123 | 11/1977 | Bartos et al. | 134/169 A |
| 4,083,399 | 4/1978 | Babish et al. | 134/169 A |
| 4,390,049 | 6/1983 | Albertson | 134/169 A |
| 4,597,416 | 7/1986 | Scales | 134/169 A |
| 4,606,363 | 8/1986 | Scales | 134/169 A |
| 4,877,043 | 10/1989 | Carmichael et al. | 134/169 A |
| 4,991,608 | 2/1991 | Schweiger | 134/169 A |
| 5,015,301 | 5/1991 | Baylor | 134/169 A |
| 5,232,513 | 8/1993 | Suratt et al. | 134/169 A |
| 5,257,604 | 11/1993 | Vataru et al. | 134/169 A |
| 5,289,837 | 3/1994 | Betancourt | 134/169 A |

*Primary Examiner*—Frankie L. Stinson
*Attorney, Agent, or Firm*—Jones & Askew

[57] ABSTRACT

In order to achieve an effective cleaning of all the cooling circuit of an automobile vehicle engine, a device is provided which consists of a tank (1) for an adequate cleaning liquid mixture which is equipped with a filling/emptying tap (2) and two in-takes (3) for insertion in said cooling circuit. In which, said tank (1) has, additionally, a pressure valve (4) and a bleeding tap (5) for reaching the preset work pressure values, preferably the operational pressure values of this cooling circuit. Additionally, and to the effects of monitoring the work pressure and the level of the cleaning liquid in tank (1), a manometer (6) and a control viewer (7) are provided. The result is an easily manageable embodiment, when, in the housing of the tank (1), fittings in the shape of a handle (8) and with rolling wheels (9), is provided.

2 Claims, 1 Drawing Sheet

Figure 1:
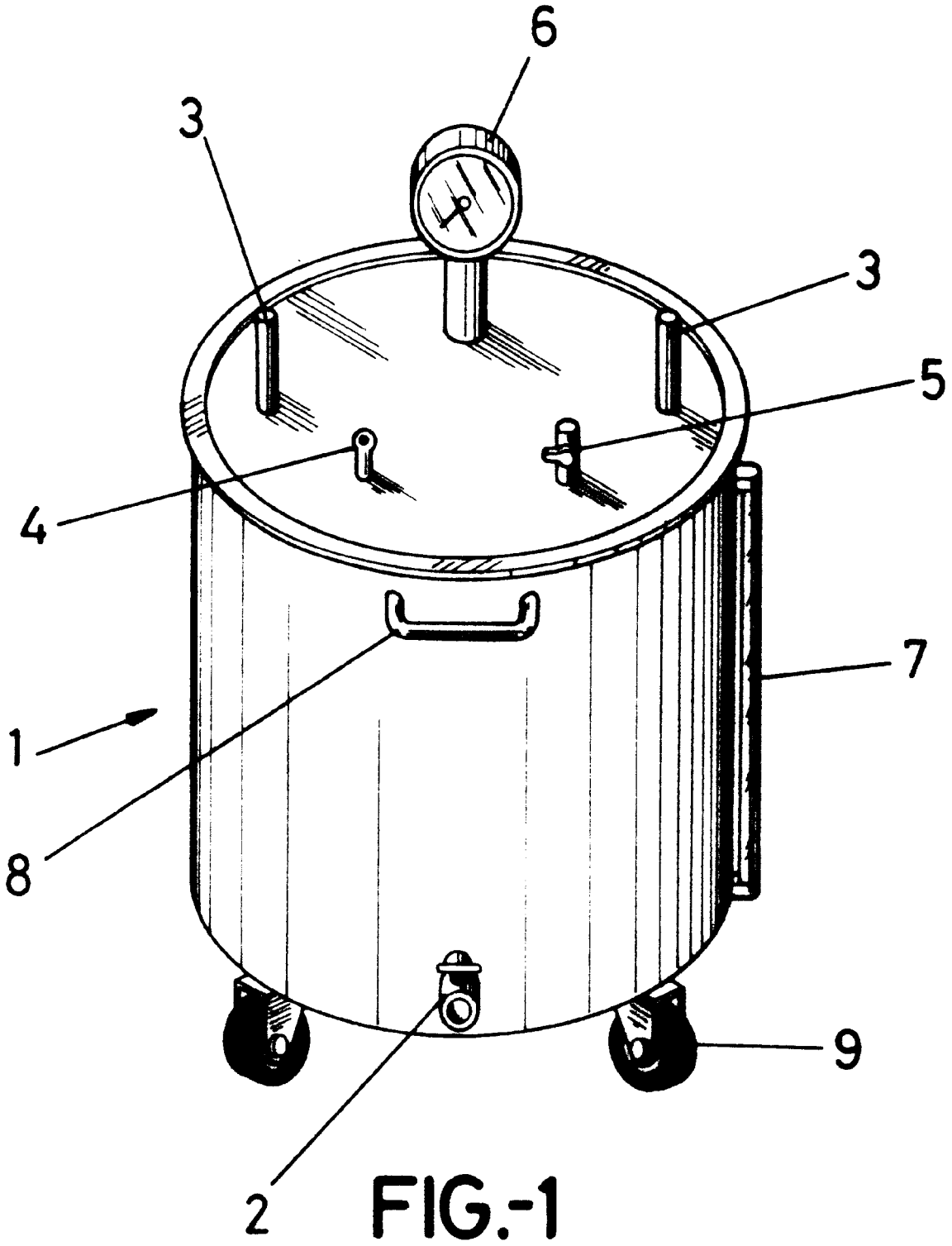

DEVICE FOR PRESSURIZED CLEANING OF COOLING CIRCUITS IN AUTOMOBILE VEHICLE ENGINES

DESCRIPTION

Device for pressurized cleaning of cooling circuits in automobile vehicle engines.

The present invention refers to a device for conducting the cleaning of cooling circuits of automobile engines, simple to use and portable, which results to be of great utility in mechanical workshops for carrying out the described object, which up to the present was not performed effectively and totally.

At present, when the cooling circuit of an automobile engine acquires dirt, which occurs frequently as a consequence of the release of oxides, etc., the total cleaning of the same is not carried out, due to lack of the necessary means. Such an operation restricts the cleaning of radiators, so that, on many occasions it is necessary to empty them of cooling liquid, so as to refill them and successively empty them more than once, with the consequent loss of coolant and loss of manpower/time, until the contents of the oxides and impurities are suitably reduced. Such a procedure, besides the costs originated, results to be absolutely imperfect due to being incomplete since the rest of the circuit is not subjected to any cleaning, thus remaining with dirt, full of oxides and impurities, which cause undesired overheating of all the parts of the engine, which may produce multiple, complex and important breakdowns, the repair of which results to be very expensive, for example, an overheating up to the irreversible deterioration of the head gasket, with the subsequent need of replacement of the same and repairing of the multiply damages which it may cause, and which even ends on multiple occasions, in the withdrawal of the vehicle for breaking.

From all the above, the need arises for the development of an aparatus or device of the type initially described, to allow the adequate cleaning of all the cooling circuit of the automobile engine, with the consequent advantages of suitable final operational adjustments, maintenance under conditions which optimize their service and conservation under ideal conditions, the repercussion of which will be a longer lifetime and lower repair costs of damages caused by dirt in said cooling circuits.

According to the invention, this task is achieved with a device in compliance with the characteristics of claim 1; other additional characteristics of the invention are listed in the dependent claims.

The device, according to the invention is characterized in that it is constituted by a tank (1) for an aqueous mixture of a cleaning liquid equipped with a filling/emptying tap (2) and two in-takes (3) for insertion in the cooling circuit which is the object of the cleaning, and where additionally, said tank has a pressure valve (4) and a bleeding tap (5) for reaching the work pressure values for the cleaning mixture, preferably, the pressure values of the performance of the cooling circuit of the automobile engine.

Additionally, according to the invention, a manometer (6) is provided, for monitoring the pressure of the cleaning mixture inside said tank (1).

Also according to the invention, it is advisable to provide a control viewer (7) for monitoring the level of the cleaning mixture inside said tank (1).

Other characteristics and advantages of the invention, will become clearer from the following description, performed with the help of the attached drawing, in relation to a non-restrictive embodiment example, and in which:

The only FIGURE shows a perspective view of a device for pressurized cleaning of cooling circuit in automobile vehicle engines according to the invention.

With reference to said FIGURE, it is observed that the device according to the invention consists of a tank 1 for an aqueous mixture of a cleaning liquid, equipped with a filling tap 2 which also serves for emptying the same, and two in-takes 3 for inserting in the cooling circuit subjected to the cleaning. Also, in order to reach the work pressure of the cleaning mixture, generally, that of the operational pressure of the cooling circuit of the automobile vehicle engine, the tank 1 consists of a pressure valve 4 and a bleeding tap 5.

In compliance with the invention, the work pressure of the cleaning mixture is monitored by means of a manometer 6 assembled in tank 1; additionally, it is advisable, also with monitoring purposes, to install a viewer 7 in the tank 1, for the level of the filling in said tank 1.

Also according to the invention, tank 1 is equipped with fittings in the shape of handles 8 and rolling wheels 9, which facilitate its displacement.

The operation of the device according to the invention, is as follows: in the first place, tank 1 is filled with the cleaning mixture through tap 2, the filling of which is carried out by means of the open bleeding tap 5, and monitoring its level through the viewer 7. Next, tank 1, already filled with the cleaning mixture, is inserted by means of the in-takes 2 inside the cooling circuit of an automobile vehicle engine (no show), for example, by dismounting a sleeve of the same, which is easily accessible. Subsequently, with bleeding tap 5 closed, and through the pressure valve 3, a pressure means is fed, for example, compressed air supplied by means of a compressor, until the work pressure is reached inside tank 1, preferable the performance pressure of the cooling circuit of the automobile vehicle engine; this operation is easily monitored by means of the manometer 6 installed in tank 1.

After conducting said operations, check by conventional means, the inexistance of leaks in said cooling circuit.

After which, the engine of the vehicle shall be started, keeping an approximate speed of 2500 revolutions per minute, during a sufficient time for the engine fan to start operating at least on two occasions.

During said process, the possible escape of bubbles through the connection in-takes must be checked, since this would determine the existance of leaks through the head gasket. Likewise, the pressure indicated by the manometer (1) must be controlled, so that if it should be excessive, reduce the same by using the bleeding tap.

If the pointed out anomaly should not occur as described, the engine fan shall be allowed to trigger off for a second time at least, after which, the vehicle engine shall remain ticking over, and tap 2 shall be opened slowly and carefully, with this, the pressure shall be reduced whilst the liquid exits from the cooling circuit, placing the tank at a pressure of 1 bar, until it is completely emptied.

Next, tap 6 is closed, repressurizing the cooling circuit, the engine shall be accelerated three times within three seconds, so as to expel the rest of the liquid which might remain inside this cooling circuit.

Once this is accomplished, the engine of the vehicle shall be stopped for approximately one hour, and after this time has elapsed, it shall be filled with cooling liquid, after bleeding the circuit and placing he sleeve, subsequent to disconnecting the hoses.

I claim:

1. Apparatus for pressurized cleaning of cooling circuits in automobile vehicle engines while the engine is operating, comprising:

a tank for an aqueous mixture of a cleaning liquid;

the tank being equipped with a liquid tap for filling or emptying the tank, a pressure tap for supplying compressed gas into the tank, and a manometer for monitoring the pressure of the cleaning mixture within the tank;

two intake fittings communicating with the tank for connecting the tank in series with the cooling circuit being cleaned; and the tank having a pressure bleeding tap selectably operable to bleed fluid pressure from within the tank so as to set the fluid pressure to a standard value predetermined for operation of the particular cooling circuit being cleaned.

2. Apparatus as in claim 1, wherein:

the tank is equipped with a control viewer operative for monitoring the level of the cleaning mixture within the tank.

* * * * *